United States Patent [19]

Gyllinder

[11] Patent Number: 4,915,126

[45] Date of Patent: Apr. 10, 1990

[54] METHOD AND ARRANGEMENT FOR CHANGING THE PRESSURE IN PNEUMATIC OR HYDRAULIC SYSTEMS

[75] Inventor: Lars Gyllinder, Stockholm, Sweden

[73] Assignee: Dominator Maskin AB, Jonkoping, Sweden

[21] Appl. No.: 222,919

[22] PCT Filed: Jan. 19, 1987

[86] PCT No.: PCT/SE87/00016

§ 371 Date: Jul. 12, 1988

§ 102(e) Date: Jul. 12, 1988

[87] PCT Pub. No.: WO87/04499

PCT Pub. Date: Jul. 30, 1987

[30] Foreign Application Priority Data

Jan. 20, 1986 [SE] Sweden ..... 8600227-6

[51] Int. Cl.[4] ..... F16K 31/14; F16K 31/38

[52] U.S. Cl. ..... 137/495; 251/50

[58] Field of Search ..... 251/25, 50, 54; 137/505.15, 494, 495

[56] References Cited

U.S. PATENT DOCUMENTS

| | | | |
|---|---|---|---|
| 668,202 | 2/1901 | Nethery | 251/25 |
| 885,459 | 4/1908 | Engler et al. | 251/25 X |
| 2,749,080 | 6/1956 | Griswold | 137/495 X |
| 2,927,605 | 3/1960 | Stephens | 251/55 X |
| 2,986,368 | 5/1961 | Moore | 251/25 X |
| 3,376,013 | 4/1968 | Mallett | 251/55 X |
| 4,549,571 | 10/1985 | Kelly | 137/66 X |

FOREIGN PATENT DOCUMENTS

| | | | |
|---|---|---|---|
| 850022 | 9/1960 | United Kingdom | 251/50 |

*Primary Examiner*—Stephen M. Hepperle

*Attorney, Agent, or Firm*—Robert E. Burns; Emmanuel J. Lobato

[57] ABSTRACT

Arrangement for producing a slow rise in pressure in pneumatic or hydraulic systems, particularly compressed-air diaphragm pumps. The arrangement includes a delivery channel having a valve, the spindle of which is connected to a diaphragm. The outlet side communicates with a chamber beneath the diaphragm. The inlet side is connected to a chamber located on the other side of the diaphragm, via a connecting passage which incorporates an adjustable throttle valve. When a load is applied, pressure medium will flow slowly into the chamber, whereas the chamber is brought immediately to the same pressure as the pressure on the outlet. A higher pressure in the chamber throttles the main flow, such that its pressure is only able to increase at the same rate as the pressure in the chamber. The chamber can be rapidly evacuated, by means of a three-way valve and a non-return valve, which closes the valve and therewith the main flow.

4 Claims, 8 Drawing Sheets

METHOD AND ARRANGEMENT FOR CHANGING THE PRESSURE IN PNEUMATIC OR HYDRAULIC SYSTEMS

The present invention relates to a method for changing the pressure in pneumatic or hydraulic systems, and more specifically, although not exclusively, for changing the pressure in compressed-air diaphragm pumps of the kind set forth in the pre-characterizing clause of claim 1. The invention also relates to an arrangement for carrying out the aforesaid method and being of the kind set forth in the precharacterizing clause of the independent apparatus claim.

The invention is particularly intended to provide a method and an arrangement which will overcome the drawbacks which occur when a medium under pressure, or pressurized medium, is supplied abruptly to a machine or like apparatus with which full pressure is not to be applied immediately. When the inlet valve for delivering such flowing pressurized media is opened, the sudden rise in pressure can result in a shock impact capable of damaging the machine and the equipment peripheral thereto. In hydraulic systems this shock impart is referred to as water hammer and in pneumatic systems as compressed-air shock. The invention, however, is not restricted to the protection of a downstream machine, but can also be applied when emptying or ventilating a pressurized system.

With regard to pneumatic systems reference is made to avoiding ventilating the system too rapidly.

Pneumatic systems can be divided into a number of categories, in which particular distinction is made between static and dynamic systems. The static systems comprise, inter alia, various cylinder arrangements, whereas the dynamic systems comprise air consuming machines, such as rotating or reciprocating machines, for example compressed-air diaphragm pumps. In the case of the static pneumatic systems, valves are commercially available which function satisfactorily, insofar as a pre-determined pressure is initially built-up in the system and the inlet valve is opened fully when the pistons of respective piston-cylinder devices or like devices occupy their dead-centre positions. This avoids jerkiness and impacts in the system.

These known valves, however, do not function satisfactorily in air consuming machines, such as pumps for instance, in which it is not possible to create a pressure build-up before full pressure working conditions are permitted, since the machine will begin to operate as soon as the air under pressure passes through the inlet delivery valve and enters the machine. This applies particularly to compressed-air diaphragm pumps. Such pumps have a variable capacity and will work smoothly from a zero capacity to a 100% capacity in dependence on the volume of air delivered thereto and on the air pressure. Consequently, if an attempt is made to build-up pressure slowly in the pump, the pump will merely operate at a slow pace, without any increase in pressure.

In addition to a closing valve, the delivery pipe, or inlet pipe, of an air consuming machine will often incorporate a pressure regulator for lowering the pressure off the mains to a desired low working pressure, or secondary pressure, and for maintaining this secondary pressure at a constant level. One known pressure regulator of this kind incorporates a delivery channel in which there is embodied a seat valve having a valve spindle which is connected to a diaphragm. A chamber on one side of the diaphragm communicates, via a hole, with the outlet side of the regulator. The other side of the diaphragm is spring biased. The bias asserted by the spring is adjusted by means of a setting knob or wheel, and therewith also the pressure desired on the outlet side of the regulator. A valve of this kind, however, can only be used to create a constant maximum pressure and cannot be used for supplying air to the machine while slowly increasing the supply of pressure.

EP 0126291 describes and illustrates a spring-biassed double-acting piston. Both sides of the piston are connected to the inlet through control valves. Furthermore, the chambers defined on respective sides of the piston can be ventilated to atmosphere through pipelines which incorporate control valves. However, no piston side is connected to the outlet side of the valve and the valve setting is made irrespective of the pressure on the outlet side of the valve.

SE 7202567-9 describes and illustrates a valve whose valve body or plug is actuated by a diaphragm through the valve spindle. The valve body, hereinafter referred to as the valve plug, is also actuated in its opening direction by a spring. Arranged on the inlet side of the valve is an adjustable coil spring which delimits an intermediate space on the inlet side of the valve aperture. The flow of fluid arriving from the inlet side to the intermediate space can be throttled smoothly and variably, by modifying the compression of the spring. The inlet communicates with the diaphragm through a pipe, so that the valve will be moved in its closing direction by the pressure prevailing in the inlet pipe. The intermediate space is also connected with the diaphragm through a further pipe, so that the valve will be actuated in its opening direction by the pressure prevailing in the intermediate space.

This valve is constructed differently to a pressure regulator and does not function in the same manner as the regulator. Among other things the valve plug of a pressure regulator is acted upon and moved by the valve spring and the inlet-pipe pressure in the opposite direction. Neither do pressure regulators include devices which are comparable with the aforesaid throttling coil-spring and do not achieve a corresponding effect.

Accordingly, the object of the present invention is to provide for the purpose of changing the pressure in pneumatic or hydraulic systems a method which is not encumbered with the aforedescribed drawbacks and which will enable the inlet pressure in dynamic, pneumatic, or hydraulic systems to be increased slowly. A further object is to achieve a slow build-up in pressure and to adjust the setting of the valve in correspondence with the rate of pressure increase on the outlet side of the valve. Another object of the invention is to provide an arrangement with which the method can be carried out.

To this end the method according to the invention is primarily characterized by the features set forth in the characterizing clause of the first apparatus claim.

The aforementioned publications teach a valve which is operated or controlled by a diaphragm or a piston, via a valve spindle. The respective chambers on the two mutually opposite sides of the diaphragm or piston communicate with the valve inlet passage via pipes and also possibly via control valves. These known valves, however, are not influenced by the pressure prevailing in the outlet passage of the valve. Consequently, the known valves are unable to achieve any adaptation to the rate of pressure increase occurring on the outlet side of the valve.

The invention will now be described in more detail with reference to an exemplifying embodiment thereof illustrated in the accompanying drawings, in which FIG. 1 is a schematic sectional view of an arrangement according to the invention;

Figure 1:
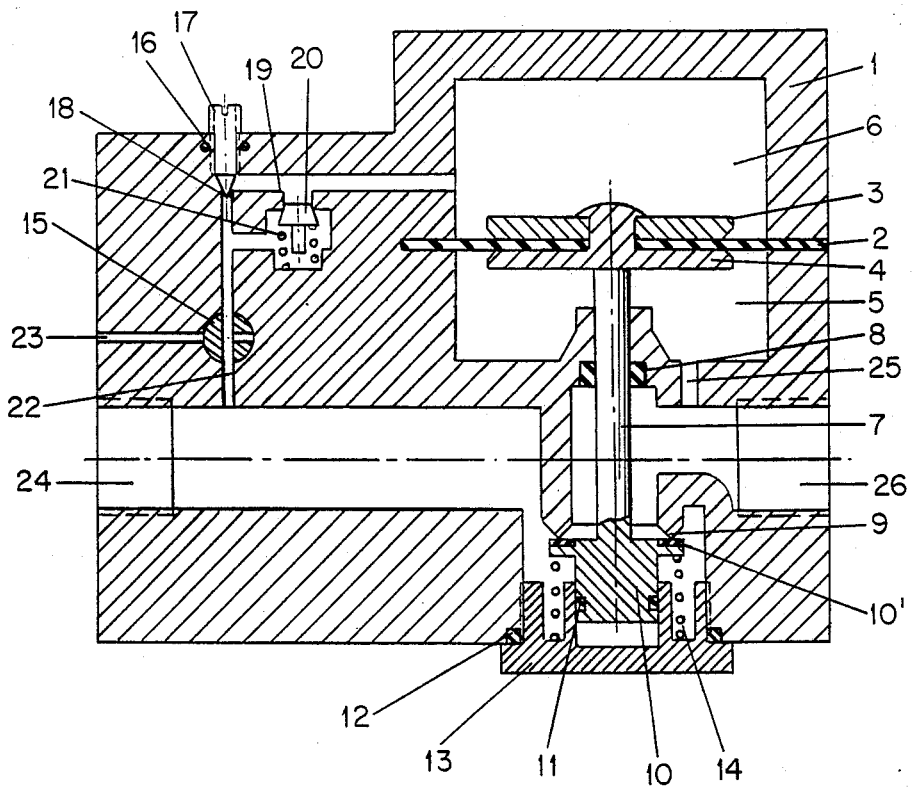

Mutually corresponding components of the various illustrated arrangements have been identified by the same reference numerals. For the sake of illustration the arrangement housing or body 1 has been shown to consist of a single monolithic block. It will be understood, however, that the housing may comprise several mutually different parts which are joined together by, e.g., pipe connections. The external configuration of the housing is therefore arbitrary and has no bearing on the functional principles of the illustrated arrangements. A number of the arrangement components have been shown in a highly schematic form in the respective Figures. It will therefore be understood that the housing is divided, or capable of being opened, in the locations of the various cavities intended for the installation/removal of diaphragms, valves and other components.

FIG. 1 illustrates a principle basic form of an arrangement constructed in accordance with the invention, which includes a delivery channel having an inlet side 24, an outlet side 26, and a valve arrangement which is located in the delivery channel and separates the inlet and outlet sides thereof. The inlet is connected to a pipe system through which gas under pressure, or pressurized gas, is conveyed and which has connected thereto a machine for generating pressurized air or gas. Alternatively, the pressurized gas may be supplied from a gas bottle or container. The valve outlet is connected to an air consuming machine, e.g. a diaphragm pump.

FIG. 1 illustrates the pressure changing arrangement in a closed, rest position. The pressurized air entering through the inlet 24 is conducted to a valve which comprises a valve seat 9, a valve plug 10, and a valve packing seal 10'. The valve plug 10 is held in position in the housing 1 by a valve hood 13, which incorporates a thrust spring 14 and seals 11, 12. The inlet 24 communicates with a chamber 6 through a channel or connecting passage 22, which incorporates a three-way valve 15, a throttle-valve seat 18 and an associated throttle-valve spindle 17. The chamber 6 is defined downwardly by a diaphragm arrangement which comprises a diaphragm 2 which is held and supported by diaphragm plates 3 and 4. The diaphragm plates are attached to a valve spindle 7 connected to the valve plug 10 in a known manner, which has not been illustrated in detail in the Figures.

When air under pressure is supplied through the inlet 24, part of the air flow will pass through the channel 22 and enter the chamber 6. As the pressure in the chamber 6 rises as a result hereof, the diaphragm assembly will move down and force down the air-valve spindle 7 and the valve plug 10. In so doing a gap is formed between the valve seat 9 and the packing 10', so that pressurized air is able to exit through the outlet 26. Part of the air exiting from the outlet 26 is able to pass through a channel or pressure equalizing passage 25 and enters a chamber 5 located beneath the diaphragm 2. This part flow of air will therewith exert on the diaphragm a counter pressure which strives to move the diaphragm upwards and therewith decrease the size of the valve through-aperture.

In the event of a rapid build-up of pressure in the outlet 26, the pressure in the chamber 5, which pressure is equal to the outlet pressure, will increase more rapidly than the pressure in the chamber 6. When the pressure in the chamber 5 equals the pressure in the chamber 6, the valve is closed by the spring 14 and the diaphragm 2 will return to its position of equilibrium or rest. The valve and the diaphragm remain in their respective closed positions until the pressure in the chamber 6 has again been able to increase to a value which is greater than the pressure prevailing in the chamber 5, whereupon the valve is opened. This sudden build-up in pressure can be the result of a closed outlet 26 or the build-up in working pressure in a working machine. On the other hand, in the event of a very slow pressure build-up in the outlet 26, the pressure difference between the chamber 6 and the chamber 5 will be correspondingly greater. The diaphragm is then subjected to a greater force and the valve will be opened to a greater extent, which results in a more rapid increase in pressure, until the pressure on the outlet side has begun to catch up and the valve aperture has decreased to a corresponding extent. Consequently, the pressure in the outlet 26 will increase smoothly at substantially the same rate as the pressure in the chamber 6, irrespective of the conditions on the outlet side.

When the outlet side is connected to a compressed-air consuming machine and there occurs a slow increase in load, the pressure will rise slowly in the chamber 6 and with a slight delay to almost an equal extent in the chamber 5 and the outlet 26. The difference comprises the pressure drop over the valve. The time taken to bring the chamber 6 to full working pressure is determined with the aid of the throttle-valve 17, 18. This time corresponds to the loading time, i.e. the time taken to raise the inlet pressure to full working pressure from the first moment of starting-up the air consuming machine.

The air consuming machine is shut down with the aid of the three-way valve 15, which to this end is adjusted to a positional setting in which the chamber 6 is connected to an outlet channel 23. This results in rapid ventilation of the chamber 6 via a non-return valve connected in parallel with the throttle valve and comprising a valve seat 19, a valve plug 20 and a holding spring 21. Naturally, part of the gas will exit, at the same time, through the throttle valve 17, 18. When air leaves the chamber 6, the pressure in the chamber 5 will be greater than that in the chamber 6 and the valve plug 10 will be moved subsequently to its valve closing position. The valve then remains closed. When the machine is again started-up, the three-way valve 15 is adjusted to the illustrated setting, therewith initiating a smooth re-start as aforedescribed. The three-way valve 15 may be, for instance, a manually operated valve, a magnetic valve, or a pneumatic valve. The last-mentioned valves may be remote-control valves.

The described pressure changing arrangement incorporates a number of seals, such as a seal 16 provided around the throttle-valve spindle 17 for example. The seal 8 which embraces the air-valve spindle 7 is, in principle, not needed for sealing purposes and serves more to guide the movement of the valve spindle 7. The valve hood 13 has provided centrally therein a cavity into which the valve plug enters. This cavity is sealed, primarily to prevent an excessive pressure drop across the valve, since otherwise a greater force would be required to open the valve, due to the fact that the full inlet pressure lies on the entire undersurface of the valve plug.

The loading time, i.e. the time taken to bring the chamber 6 to the desired working pressure, is controlled essentially with the aid of the throttle valve 16, 17, but can also be varied by commensurate modification to the volume of the chamber 6.

In accordance with the invention, the diaphragm 2 of the illustrated pressure changing arrangement can be replaced with a piston and sealing system. The use of a piston will enable greater lengths of stroke to be obtained with chambers 5 and 6 of small external dimensions. The use of a piston, however, is encumbered with sealing problems, and a diaphragm will afford the simplest and cheapest solution in the case of a number of applications.

Figure 2:
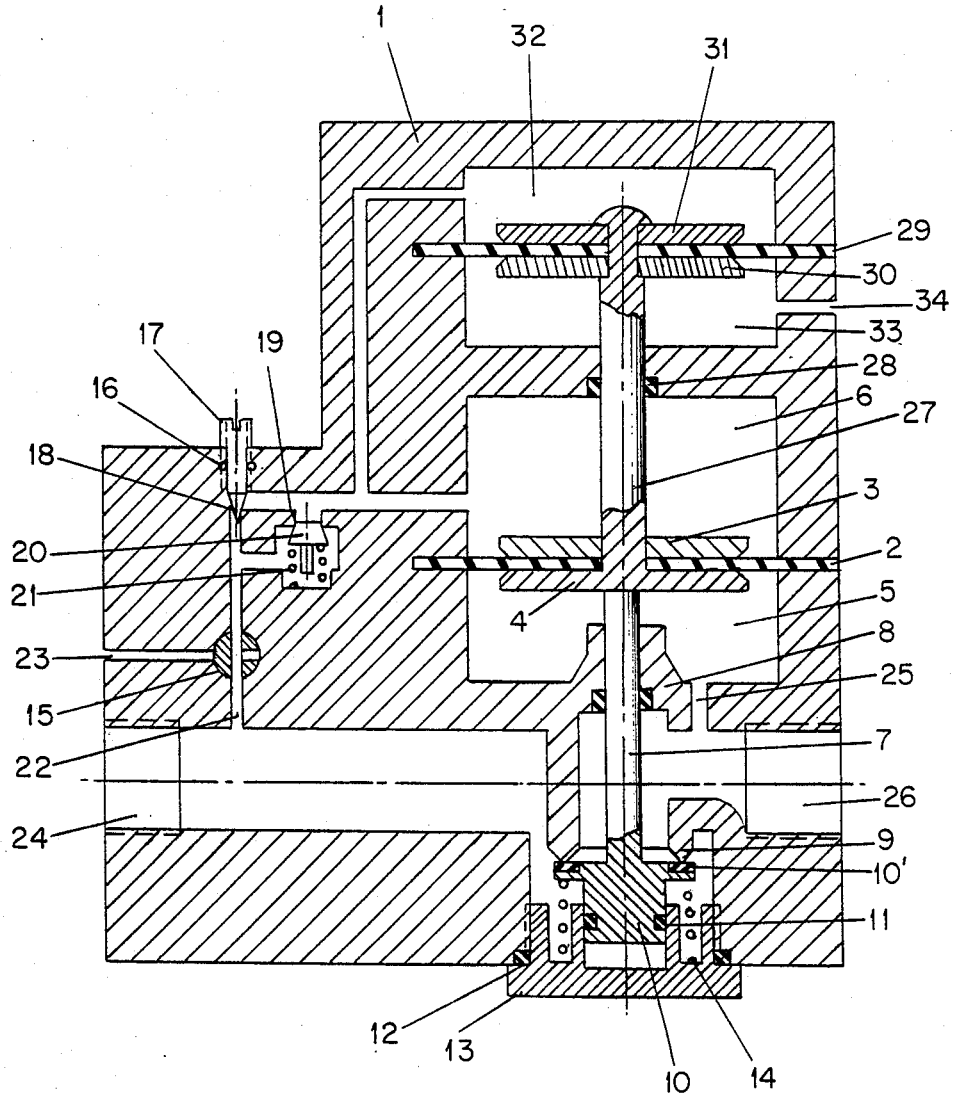
FIG. 2 illustrates an arrangement which corresponds to the arrangement shown in FIG. 1 and which includes a compensating device in the form of a diaphragm.

In the case of the arrangement illustrated in FIG. 1, a given pressure drop will always prevail over the valve, thus a pressure difference between the inlet side 22 and the outlet side 26, depending on the force exerted by the spring 14. This can be counteracted by providing the valve with a further diaphragm system 29, 30, 31 with associated chambers 32, 33, as illustrated in FIG. 2. In this arrangement the forces acting on the upper face of the diaphragm are much greater than those which act on the bottom face thereof, due to the fact that full working pressure prevails in the two downwardly acting chambers 6 and 32. An upwardly directed, full working pressure also prevails in the chamber 5. The undersurface of the diaphragm 29, on the other hand, is exposed to ambient atmospheric pressure, since the chamber 33 is in communication with the ambient surroundings through a channel 34. The upper valve spindle 27 of the arrangement is provided with a seal 28 which seals the chamber 6 from the chamber 33.

The force exerted by the spring 14 is overcome with the aid of the forces acting on the diaphragm system 29, 30, 31. In this way, there is obtained a valve arrangement in which, subsequent to a smooth starting-up period, there is practically no pressure drop over the valve while retaining, at the same time, the possibility of a smooth start with a slow pressure increase.

The use of the three-way valve 15 affords an important advantage, since it is possible in this way to control a very large flow of gas with a very small three-way valve. A three-way valve having a through-passage diameter of, e.g. 2 mm can be used to operate valves which have a delivery channel or main through-passage of, e.g., 150–200 mm in diameter.

The three-way valve 15 and the channel 23 can be omitted when the flow is cut-off upstream of the inlet 24 in some other way and the system is evacuated downstream of the location at which the flow is cut-off. This can be achieved, for example, with a three-way valve located upstream of the inlet 24, this three-way valve when closed resulting in the evacuation of the system downstream of the valve.

The arrangement illustrated in FIGS. 1 and 2 is able to produce a slow increase in pressure during a start, but cannot limit the maximum pressure of the system. Thus, this arrangement assumes the presence of a pressure regulator at some other location in the system, e.g. an upstream location, or assumes that it is not necessary to limit the maximum pressure.

Figure 3:
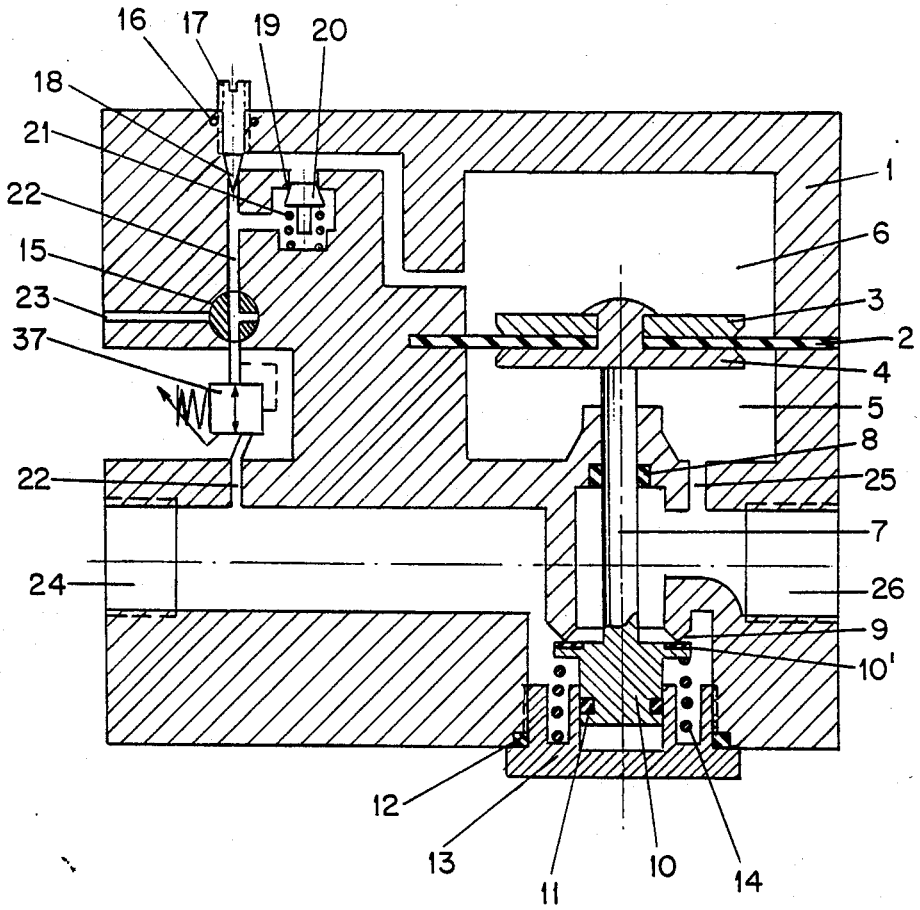
FIG. 3 illustrates an arrangement which corresponds to the arrangement shown in FIG. 1 and which incorporates a pressure regulator for restricting the outlet pressure.

FIG. 3 illustrates an embodiment of the invention which will also enable the pressure to be restricted on the outlet side. The system illustrated in FIG. 3 corresponds to the system illustrated in FIG. 1, with the exception that there is incorporated in the channel 22, upstream of the three-way valve 17, a conventional pressure regulator 37 by means of which the maximum pressure in the chamber 6 can be limited to a lower value than the pressure that prevails in the inlet 24. The pressure in the outlet 26 is thereby correspondingly restricted at the same time. The pressure regulator 37 is described in more detail hereinafter with reference to FIG. 8.

Advantageously, the pressure regulator 37 can be very small with a small through-flow aperture and may be of low capacity, since the chamber 6 has a small volume and the rise in pressure therein is effected slowly in order to achieve a gentle or soft start. At the same time, the through-flow aperture, i.e. the capacity, of the actual soft-start valve 9, 10 may be very large. The pressure regulator 37 need not necessarily be incorporated in the housing 1, but may be arranged at a location remote from the housing, e.g. on a control panel or some like device. The control panel may also incorporate means for adjusting the positional setting of the three-way valve 15, or may even incorporate the actual three-way valve itself. In this case the pressure regulator 37 is connected to the channel 22 in the housing 1 by means of pipes or pressure hoses.

Figure 4:
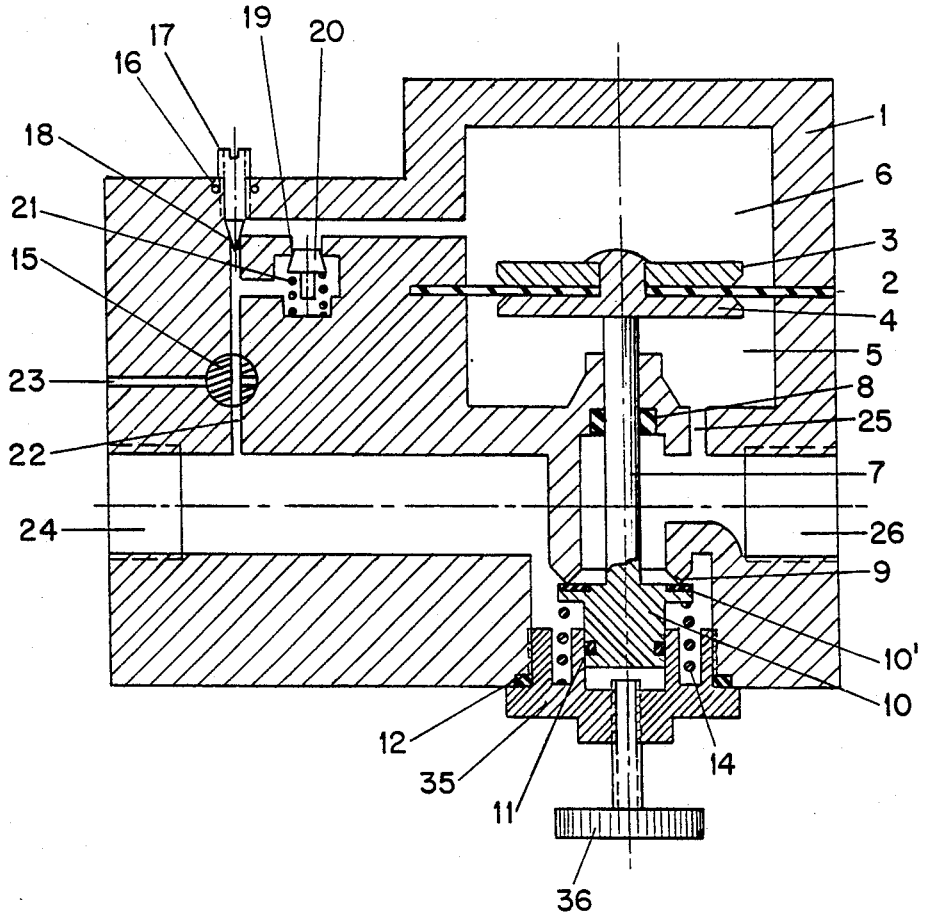
FIG. 4 illustrates an arrangement which corresponds to the arrangement shown in FIG. 1 and which incorporates a setting screw for restricting the maximum throughflow opening.

FIG. 4 illustrates an embodiment of the invention corresponding to the arrangement illustrated in FIG. 1, although with the exception that the valve hood 13 of the FIG. 1 embodiment has been replaced with a valve hood 35 that presents a screw-threaded central hole which accommodates a setting screw 36. This setting screw is effective for restricting the downward movement of the valve plug 10 and therewith the extent to which the valve can be opened, thereby restricting and controlling the amount of air that passes between the valve seat 9 and the packing seal 10'.

Thus, there is provided a soft-start valve with which the main flow can be throttled initially while maintaining maximum working pressure. When the screw 36 is tightened down to its fullest extent, no medium can pass through the valve and an inexpensive closing valve has been obtained.

Figure 5:
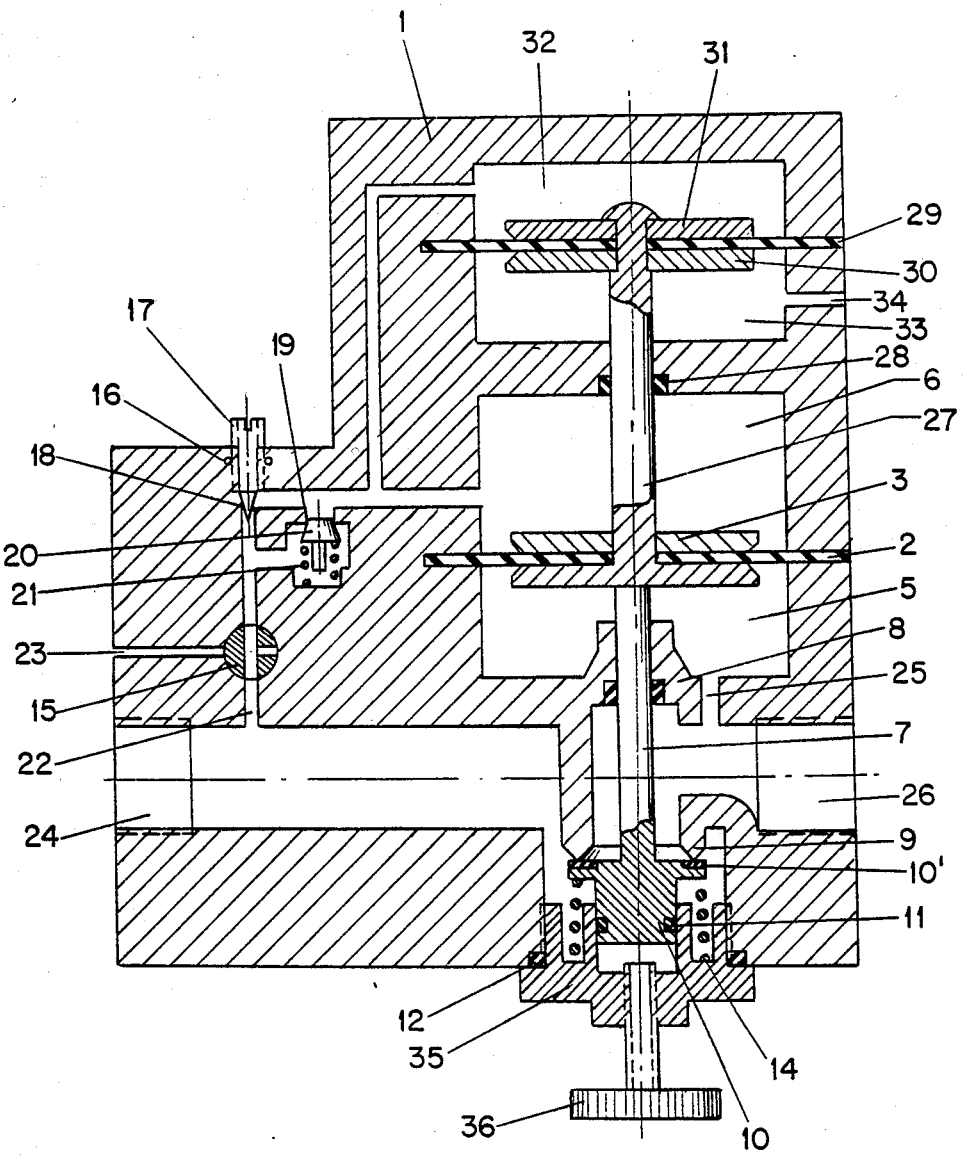
FIG. 5 illustrates an arrangement which corresponds to the arrangement shown in FIG. 1 and which incorporates a diaphragm according to FIG. 2 and a setting screw according to FIG. 4.

FIG. 5 illustrates an embodiment which combines the embodiments of FIGS. 2 and 4. The embodiment illustrated in FIG. 5 works analogously with the previously described embodiments and affords corresponding advantages.

Figure 6:
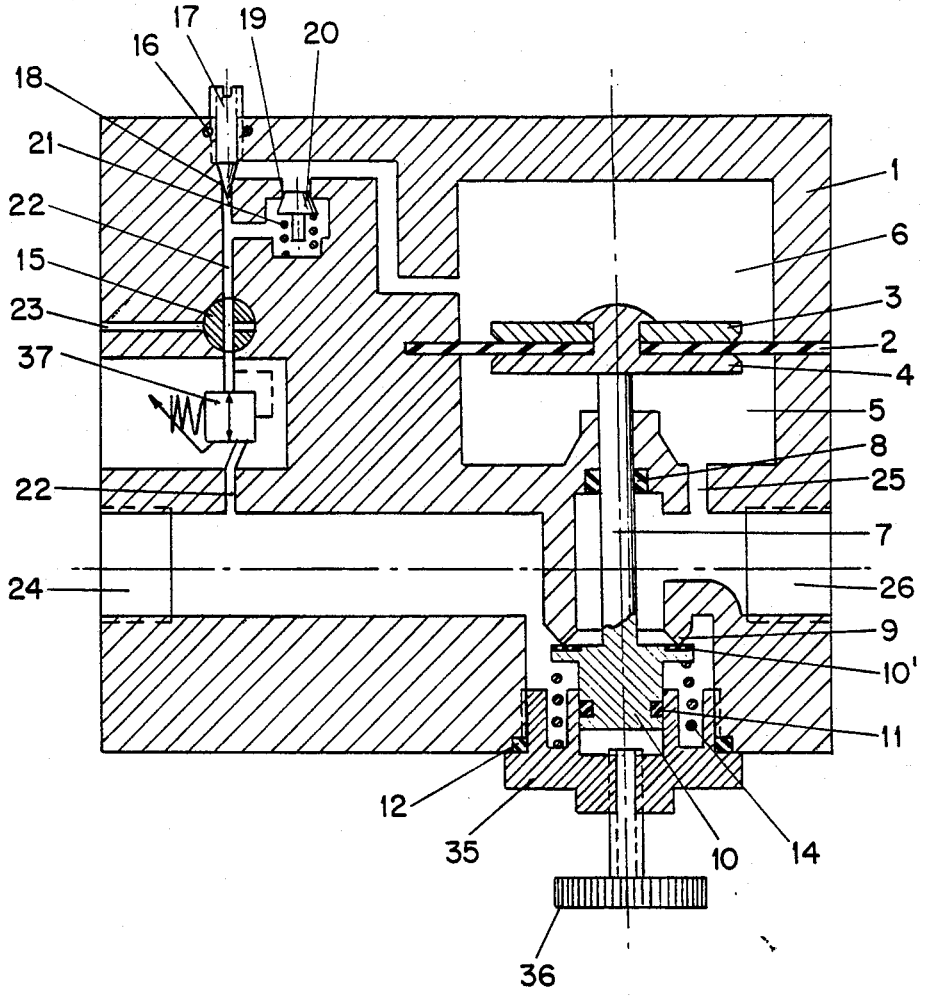
FIG. 6 illustrates an arrangement which corresponds to the arrangement shown in FIG. 2 and which incorporates a pressure regulator according to FIG. 3 and a setting screw according to FIG. 4.

FIG. 6 illustrates an inventive embodiment which comprises a combination of the embodiments illustrated in FIGS. 3 and 4.

Figure 7:
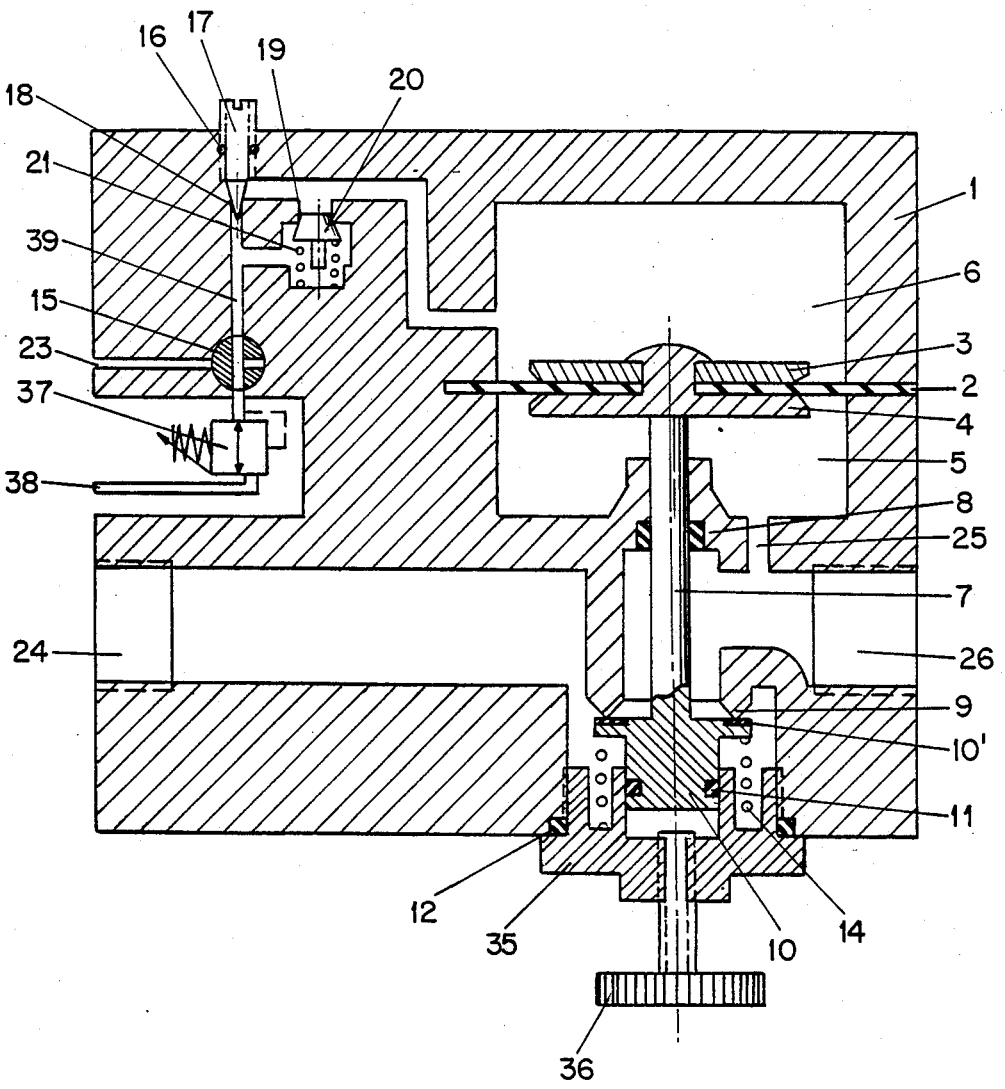
FIG. 7 illustrates an arrangement which corresponds to the arrangement shown in FIG. 6 and which incorporates a delivery line for delivering pressure medium to a pressure regulator from a separate pressure-medium source.

The embodiment illustrated in FIG. 7 corresponds substantially to the embodiment illustrated in FIG. 6, with the exception of a separate supply of pressure-gas to the pressure regulator 37. This gas serves as control air and is delivered to the pressure regulator 37 through a pipe 38 and continues from the regulator 37 through a passage 39 corresponding to the air passage 22. This system can be used when the regulated main flow is a liquid, a suspension, or an expensive, poisonous, explosive or inflammable gas. It will be understood that all of the embodiments aforedescribed with reference to FIGS. 1–6 can be provided with a similar supply of control air taken from a separate source of pressure gas.

Figure 8:
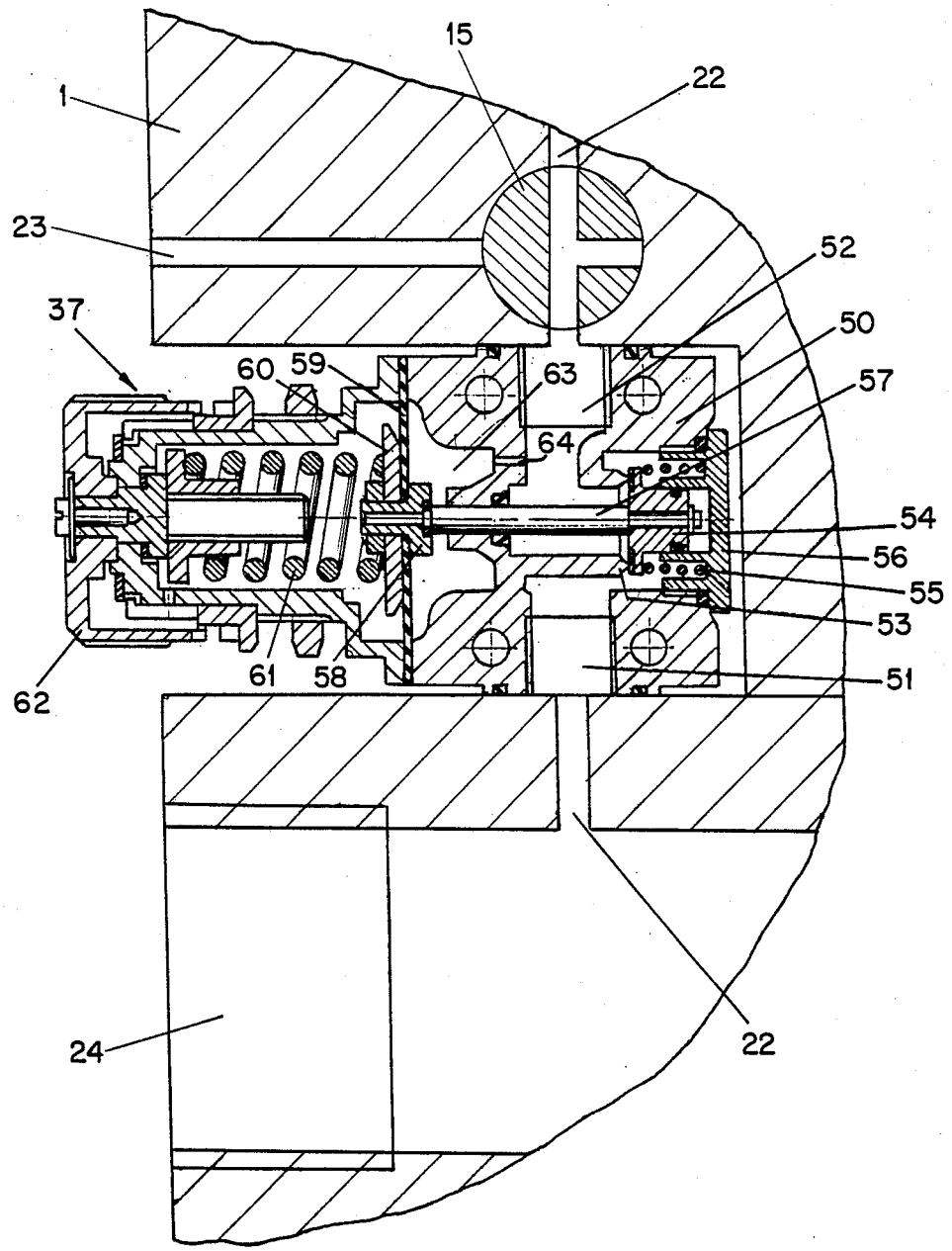
FIG. 8 is a cut-away detail view of the pressure regulator illustrated in FIGS. 3 and 6 and of the components located in the close proximity of the regulator.

FIG. 8 illustrates part of an arrangement according to the invention in which a pressure regulator 37 is incorporated in the passage 22, in accordance with the illustrations of FIGS. 3 and 6. The pressure regulator 37 comprises a housing 50 which incorporates an inlet channel 51 and an outlet channel 52, which channels are separated by a valve which comprises a valve seat 53 and a valve plug 54. The valve plug is spring biassed with the aid of a thrust spring 55 abutting a valve hood 56. The valve spindle 57 abuts a lower diaphragm plate 58 which has a hole located centrally therein. The diaphragm plate 58 is attached to a diaphragm 59 and an upper diaphragm plate 60. The diaphragm plate 60 is loaded by a spring 61, the bias or pre-tension of which can be adjusted with the aid of a setting knob or wheel 62. A chamber 63 located on the underside of the diaphragm communicates with the outlet channel 52 through a passage 64.

The pressure desired on the outlet side is set by means of the setting knob 62. The diaphragm and the valve plug are pressed downwards and the valve consequently opened. The pressurized medium is now able to pass to the outlet side and through the passage 64, into the chamber 63, where the medium exerts on the diaphragm a counter-pressure which acts in the closing direction of the valve. When the desired outlet pressure is reached, the pressure in the chamber 63 will balance the pre-set spring pressure in the valve-closed position. If the pressure on the outlet side is too high, the diaphragm and the lower diaphragm plate are lifted from the spindle 57, so as to expose the central hole in the diaphragm plate. Pressure gas can now be evacuated through the central hole until again reaching the desired pre-set pressure on the outlet side.

A manometer for sensing the pressure on the inlet side 24 can be mounted on the arrangement, for the purpose of controlling the pressure in the system.

The secondary pressure can be detected at the outlet 26 or in the chamber 6, since the pressure therein shall be practically equal to the outlet pressure.

In the case of the embodiments illustrated in FIGS. 3, 6 and 7 it is preferred to measure the secondary pressure at a location between the pressure regulator 37 and the three-way valve 15, since the desired secondary pressure can then be set, with the aid of the pressure regulator 37, before the main delivery channel of the arrangement is opened, by opening the three-way valve 15.

The aforedescribed exemplifying embodiments of the arrangement according to the invention include a valve which comprises a valve plug and an opposing valve seat. The invention is not, of course, restricted to this particular type of valve, and it will be understood that any suitable type of valve or throttling device can be used for decreasing the through-flow area and therewith to lower the pressure in a pipe. The manner in which movement of the diaphragm 2 is transmitted mechanically to the valve is adapted to the manner in which the valve operates, e.g. rectilinear movement, rotational movement or hydraulic throttling of a rubber-sleeve section.

The valve according to the invention may also be provided with a spring in the chamber 6 corresponding to the spring 61 of the FIG. 8 embodiment. This spring counter-acts the spring 14 in a manner such that the valve will be partially open when in its rest position. This may be desirable in certain applications to which the pressure changing arrangement according to the invention is put. This embodiment, however, assumes that the system includes a separate closing device, preferably upstream of the valve.

The use of an arrangement according to the invention is not restricted to dynamic, pneumatic or hydraulic machines, since the arrangement can also be used in other contexts in which a slow pressure increase to full pressure is desired, e.g. when depressurizing or evacuating a pressurized system.

The arrangement according to the invention can be used for transporting both gases and liquids in the main channel or delivery channel. A compressible medium, on the other hand, i.e. a gas, should be delivered to the chamber 6 through the throttle valve 17, 18, so as to achieve the desired slow rise in pressure. Alternatively, the chamber 6 may have enclosed therein a given quantity of gas capable of producing the same effect. This gas is preferably enclosed in a rubber bladder or the like, of the kind used, inter alia, in closed expansion vessels in heating systems.

The invention is not restricted to the aforedescribed embodiments, since modifications can be made thereto within the scope of the following claims.

I claim:

1. Apparatus for changing the pressure in a fluid pressure system to produce a slow rise in pressure, comprising a delivery channel having an inlet side and an outlet side, valve means in said delivery channel between said inlet side and said outlet side, said valve means comprising a valve seat and a valve member movable between a closed position in which it is seated on said valve seat and an open position, means for elastically biasing said valve member toward closed position, said valve member having a valve spindle connecting said valve member with a diaphragm dividing a chamber into a first chamber portion in which fluid pressure exerts a force on said diaphragm in a direction to move said valve member toward closed position and a second chamber portion in which fluid pressure exerts a force on said diaphragm in a direction to move said valve member to open position, a first passageway connecting said first chamber portion with said delivery channel on the outlet side of said valve means, a second passageway connecting said second chamber portion with a three-way valve means for connecting said second chamber portion alternatively with said delivery channel on the inlet side of said valve means or with an outlet passageway, variable throttling means in said second passageway between said three-way valve means and said second chamber portion and a non-return valve connected in parallel with said variable throttling means.

2. Apparatus according to claim 1, further comprising means for variably limiting the opening of said valve means in said delivery channel.

3. Apparatus according to claim 1, further comprising a second diaphragm on said valve spindle, said second diaphragm dividing a second chamber into a third chamber portion in which fluid pressure exerts a force on said second diaphragm in a direction to move said valve member toward closed position and a fourth chamber portion in which fluid pressure exerts a force on said second diaphragm in a direction to move said valve member toward open position, a third passageway connecting said third chamber portion to atmosphere and a forth passage connecting said fourth chamber portion with said second chamber portion.

4. Apparatus according to claim 1, further comprising pressure regulating means interposed between said three-way valve means and said delivery channel on the inlet side of said valve means.

* * * * *